US006877327B2

(12) United States Patent
Newman et al.

(10) Patent No.: US 6,877,327 B2
(45) Date of Patent: Apr. 12, 2005

(54) FLOW ENHANCED TUNNEL FREEZER

(75) Inventors: Michael D. Newman, Hillsborough, NJ (US); Stephen A. McCormick, Warrington, PA (US); D. Scott Boyles, Telford, PA (US); Robert Muscato, Monmouth Junction, NJ (US)

(73) Assignee: The BOC Group, Inc., Murray Hill, NJ (US)

( * ) Notice: Subject to any disclaimer, the term of this patent is extended or adjusted under 35 U.S.C. 154(b) by 0 days.

(21) Appl. No.: 10/641,998

(22) Filed: Aug. 15, 2003

(65) Prior Publication Data

US 2004/0099005 A1 May 27, 2004

Related U.S. Application Data

(60) Provisional application No. 60/404,720, filed on Aug. 20, 2002.

(51) Int. Cl.[7] ..... F25D 17/02; F25D 25/04; F25D 17/04

(52) U.S. Cl. ..... 62/64; 62/374; 62/380; 62/418

(58) Field of Search ..... 62/63, 64, 374, 62/380, 418, 417

(56) References Cited

U.S. PATENT DOCUMENTS

| | | | | | |
|---|---|---|---|---|---|
| 1,491,958 | A | * | 4/1924 | Franklin et al. | 99/363 |
| 3,701,263 | A | | 10/1972 | Barrett | |
| 3,708,995 | A | | 1/1973 | Berg | |
| 3,757,533 | A | | 9/1973 | Kent | |
| 4,171,625 | A | | 10/1979 | Morgan et al. | |
| 4,333,318 | A | | 6/1982 | Tyree, Jr. | |
| 4,356,707 | A | | 11/1982 | Tyree, Jr. et al. | |
| 4,479,776 | A | | 10/1984 | Smith | |
| 4,580,411 | A | | 4/1986 | Orfitelli | |
| 4,626,661 | A | * | 12/1986 | Henke | 219/400 |
| 4,783,972 | A | | 11/1988 | Tyree, Jr. et al. | |
| 4,803,851 | A | | 2/1989 | Stokes | |
| 4,866,946 | A | | 9/1989 | Klee | |
| 4,953,365 | A | | 9/1990 | Lang et al. | |
| 5,020,330 | A | | 6/1991 | Rhoades et al. | |
| 5,170,631 | A | | 12/1992 | Lang et al. | |
| 5,218,826 | A | | 6/1993 | Kirschner et al. | |
| 5,220,803 | A | | 6/1993 | Kiczek | |
| 5,335,590 | A | * | 8/1994 | Crump et al. | 99/479 |
| 5,349,828 | A | | 9/1994 | Lee et al. | |
| 5,417,074 | A | | 5/1995 | McAfee et al. | |
| 5,487,908 | A | | 1/1996 | Appolonia et al. | |
| 5,551,251 | A | * | 9/1996 | Ochs et al. | 62/380 |
| 5,606,861 | A | * | 3/1997 | Renz | 62/63 |
| 5,740,678 | A | * | 4/1998 | Lee et al. | 62/63 |
| 5,765,381 | A | | 6/1998 | Renz | |
| 5,878,582 | A | | 3/1999 | Appolonia et al. | |
| 6,151,913 | A | | 11/2000 | Lewis et al. | |
| 6,263,680 | B1 | * | 7/2001 | Newman et al. | 62/63 |
| 6,334,330 | B2 | | 1/2002 | Lang et al. | |
| 6,434,950 | B2 | | 8/2002 | Newman et al. | |
| 2001/0013227 | A1 | | 8/2001 | Lang et al. | |
| 2001/0025495 | A1 | | 10/2001 | Newman et al. | |

* cited by examiner

*Primary Examiner*—William C. Doerrler
(74) *Attorney, Agent, or Firm*—Joshua L. Cohen

(57) ABSTRACT

Food products are frozen or cooled within a housing chamber defined by side walls between an ceiling and floor and having a cryogen supply, a food products conveyor extending into the chamber disposed between the ceiling and floor, by transporting the food products on the conveyor; the chamber containing at least one impingement hood disposed above the conveyor; the impingement hood including a shell including a top, opposed edges and opposed side walls supporting an impinger containing openings. Gas and solid or liquid cryogen are mixed within the impingement hood, the mixture of gas and cryogen are directed to the impinger, and impingement jets of the mixture are directed through an impingement plate onto the food products transported on the conveyor.

21 Claims, 7 Drawing Sheets

FLOW ENHANCED TUNNEL FREEZER

CROSS REFERENCE TO RELATED APPLICATIONS

This application claims the benefit of the filing date of U.S. Provisional Application for Patent Ser. No. 60/404,720 filed Aug. 20, 2002.

FIELD OF THE INVENTION

The present invention relates to an improved method and device for chilling and freezing a food product or other item, which is carried through the device on a conveyer belt or other moving substrate.

BACKGROUND

Commercial freezers typically rely on the transfer of heat from a food product that is to be chilled or frozen by using a fan or blower. Typically, the fan or blower is situated near a conveyer belt upon which the food product is being carried. The food product entering the freezer has a boundary layer of air surrounding it which insulates the food product from the surrounding atmosphere. Traditional freezers have employed blowers that generate currents of cooling vapor in many directions. However, a significant portion of the cooling vapor does not contact the food product in a perpendicular direction. Under these conditions, the cooling vapor which does contact the food product often does not possess sufficient energy to substantially reduce the thickness of the boundary layer around the surface of the food product. Therefore, there is a need to generate directed jets of cooling vapor so as to disturb the boundary layer.

U.S. Pat. No. 4,479,776 to Smith discloses an apparatus using a plurality of vertical tubes to provide a unidirectional air flow toward the food product.

U.S. Pat. No. 4,626,661 to Henke discloses the use of a plurality of nozzles along the pathway of a food product for delivering discrete jets of unidirectional cooling air.

However, the use of tubes or nozzles to direct air in a cooling or freezing device has met with only limited success due to the build-up of condensation in the form of snow or ice in the tubes or nozzles. Such build up quickly reduces the efficacy of the cooling or freezing devices.

U.S. Pat. No. 5,487,908 to Appolonia et al. discloses a method and device for heating or cooling a food product on a moving substrate in which a continuous channel traversing at least a major portion of the width of the moving substrate converts multi-directional flow into unidirectional flow. However, such a device suffers from having such an increased rate of flow that the food products become entrained in the flow, and, consequently, controlled processing of the food item through the device becomes difficult.

Increasing the velocity of the stream of cooling vapor (or cryogen) which impinges the food item will increase the average heat transfer coefficient in a linear manner. At a certain point, however, unless the impingement stream of cooling vapor is carefully controlled, the velocity may also be sufficient to damage the food product, or to carry the food product off the conveyor, and into undesirable locations elsewhere in the freezer.

The total heat transfer rates are dependent on local heat transfer coefficients. That is, the amount of heat transferred from the food products to the cryogen is dependent on the rate of heat transfer locally between the cryogen and the food product. Local heat transfer rates can be changed by controlling the distance from the source of impingement stream to the food product, the velocity of the impingement stream, the turbulence in the impingement stream, and the efficiency of the flow of cryogen.

Therefore, a need remains for a device which can rapidly chill and/or freeze a food product with the heat transfer to a cryogen, such as $CO_2$ or $N_2$, while reducing the amount of cryogen needed by extracting the maximum cooling effect from a given amount of the cryogen. The device must also be capable of transporting food product from an inlet to an outlet without damaging the food product. Additionally, the device must be able to control the throughput of food items, and must be resistant to the freezing and plugging of internal components by snow and ice build-up.

SUMMARY

An apparatus is provided for cooling or freezing food products comprising: a housing having a chamber defined therein by side walls between a ceiling and floor of the housing; at least one conveyor extending into the chamber between the ceiling and floor; a solid or liquid cryogen supply; and, at least one impingement hood in the chamber disposed above the conveyor; the impingement hood comprising: a shell having a top, opposed edges and opposed side walls supporting an impinger, a coolant delivery device in communication with the cryogen supply, the coolant delivery device enclosed by the shell including a gas circulation device for directing a mixture of gas and cryogen to the impinger, the impinger comprising an impingement plate containing openings for directing impingement jets of the mixture onto the products transported on the conveyor.

A process is provided for cooling or freezing food products within a housing chamber comprising: transporting the food products on a moving substrate within the chamber; mixing gas and solid or liquid cryogen within an at least partially enclosed impingement hood above the substrate; and, selectively directing pressurized impingement jets of the mixture from the impingement hood onto the food products transported on the substrate. The cryogen may be introduced within the impingement hood and/or within the housing chamber external to the impingement hood, with the circulating of gas and cryogen into the impingement hood for further mixing with the gas.

In one embodiment, the housing chamber includes at least an upper and a lower food products transport substrate, wherein the upper substrate has openings to permit the impingement jets to penetrate to the food products on the surface of the lower substrate, the process further including directing the impingement jets to contact the food products on the upper substrate and on the lower substrate.

The process may include re-circulating the mixture of gas and the cryogen after impingement onto the food products from the housing chamber into the impingement hood.

An impingement hood is further provided for a freezing or cooling apparatus comprising: a shell having a top, opposed edges and opposed side walls supporting an impinger; the shell being adapted to accommodate a coolant delivery device including a gas circulation device for directing a mixture of gas and solid or liquid cryogen to the impinger, the impinger comprising an impingement plate containing openings for providing impingement jets of the mixture external to the shell.

BRIEF DESCRIPTION OF THE DRAWINGS

The accompanying drawings are included to provide a further understanding of the invention and are incorporated in and constitute a part of this specification. The drawings illustrate embodiments of the invention, and, together with the description, serve to explain the principles of the invention, but are not intended to limit the invention as encompassed by any claims forming part of the application.

DETAILED DESCRIPTION

Figure 1:
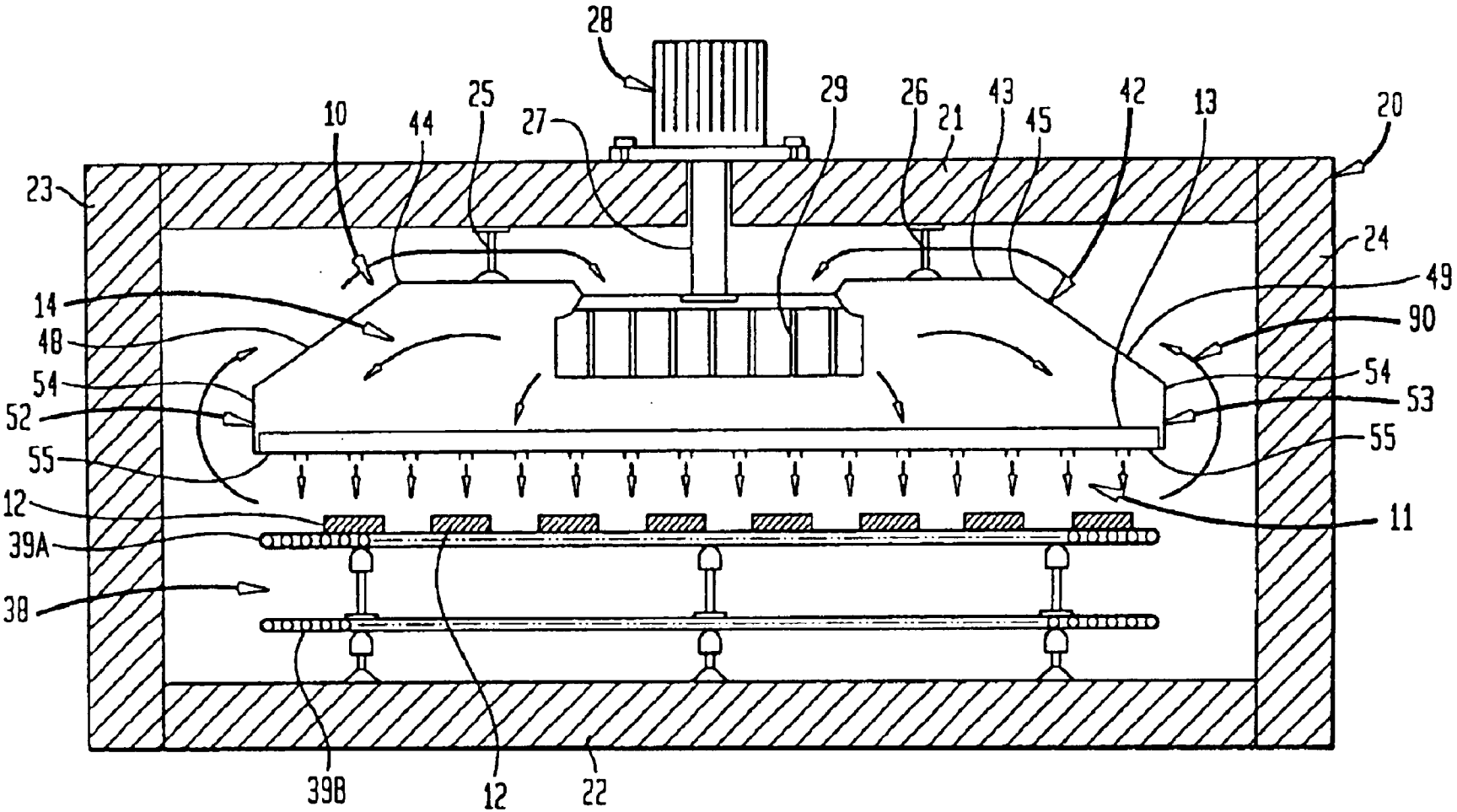
FIG. 1 is a cross-sectional view of the tunnel freezer of the first embodiment.

The present invention is directed to an apparatus for cooling and/or freezing food products in which a food item is conveyed on a conveyor, such as a belt or other moving substrate into a housing chamber in which the food product is cooled or frozen due to its contact with gaseous, liquid or solid phase cryogens, such as nitrogen or carbon dioxide.

The heat transfer resulting in the cooling or freezing of the food products results generally from the impingement of a stream of cryogenic vapor on the food item. Additional heat transfer may also be achieved by spraying or mixing liquid or solid cryogen into the impingement jet streams of cryogenic vapor.

The transfer of heat from an item, such as a food product to a cryogen is maximized through the use of an impingement hood by which solid or liquid cryogen is sprayed into gas (such as carbon dioxide or nitrogen) circulated at the item or food product while using an impinger, such as an impingement plate, to create a stream of cryogen. The design of the device increases the heat transferred from the item or food product to the cryogen. The cryogen, for example solid carbon dioxide snow or nitrogen liquid, is introduced into an impinging flow of gas, wherein heat transfer occurs with respect to the gas and the food product, to cool the product during impingement.

The use of the impingement hood increases the amount of heat transferred from an item, or food product, to the cryogen by generating impingement jets capable of breaking through the thermal boundary layer of the food product, but which are not capable of damaging the item or product.

In one embodiment, a modular food chilling and/or freezing apparatus is provided which comprises a module and a conveyor, or belt, upon which food product is transported. The module contains an impinger which enables high velocity jets of cryogenic gases to be introduced into the impingement chamber of the module to effect heat transfer in the chamber and provide for impingement cooling of the food product, i.e. cooling gas to the upper surfaces of the food items. The impinger may be an impingement plate having a configuration of rounded or chamfered holes. In another embodiment the impinger may comprise a series of channels. A sprayer may be provided in one or more modules in order to entrain droplets of liquid or solid cryogen in the jets of cryogenic gas. In another embodiment, a sprayer may be used in one or more modules in order to distribute solid or liquid cryogen directly onto the surface of the food product.

The impingement hood provides the cooling/freezing effect of the impingement substantially from the top of the freezer apparatus; the impingement jets being directed downward, generally transverse to the path of the conveyor belt and product. Use of the impingement hood provides jets of cryogenic gas to impinge the surface of the food product without causing the food product to become entrained in the impingement jets.

Further, use of the impingement hood provides consistent cooling and or freezing of the food product items across the width of the belt upon which the food items travel through the freezer. The impingement hood provides for an increased coolant pressure at the area of the conveyer belt along which the food products travel for freezing or cooling. The impingement hood may further result in the reduction in the dehydration of the food items, which is accomplished through the immediate freezing of the exterior of the food product upon entry into the apparatus.

In one embodiment, use of the impingement hood provides an efficient path for re-circulation of cryogenic gases back to a blower or impeller, so as to increase the efficiency of the freezer.

In a further embodiment a pneumatically actuated ball vibrator is used to remove the build-up of snow and ice from impingement plates.

A continuous temperature can be provided throughout the flow path for the food products subjected to the impingement process, i.e., an isothermal temperature can be provided throughout the apparatus chamber and freezing/cooling process, as opposed to having different temperatures at the inlet and exit of the apparatus. This can be facilitated by sensing the temperature of the impinging chamber of the apparatus, to control consistency of the isothermal temperature.

The impingement hood may be provided as a retrofit design, which can be adapted to provide a plurality of solutions to food processing requirements. In certain embodiments, for example, a retro-fit package may be used to transform a standard freezing tunnel, such as a carbon dioxide tunnel freezer, which utilizes axial flow fans, into a top down impingement type gas flow arrangement as described herein, that can double the production rate as compared to the standard system.

It is to be understood that both the foregoing general description and the following detailed description are exemplary, and are intended to provide further explanation of the invention as claimed.

The present invention is directed to an impingement hood, such as those generally indicated by the numeral 10, and flow enhanced tunnel freezers 20 and 30 employing the impingement hood 10. The impingement hood 10 can be incorporated into the tunnel freezers 20 and 30 as original equipment, or, when possible, can be incorporated into existing equipment as a retrofit kit.

The impingement hood 10 is used to generate impingement jets 11 of solid or liquid cryogen (such as $CO_2$ or $N_2$) mixed with gas circulated through the impingement hood 11 to chill or freeze a food product 12. In practice, the impingement jets 11 are streams of a mixture 14 of gases and cryogenic solids or liquid that increase the amount of heat transferred from the food product 12 to the solid or liquid cryogen. That is, the transfer of heat from the food product 12 to the cryogen is maximized through the use of a process in which the cryogen, in either solid or liquid form, is supplied either inside or outside the impingement hood 10 and mixed with circulated gas, and the subsequently created gas and cryogen mixture 14 is directed to an impinger 13 to generate the impingement jets 11.

Figure 2:
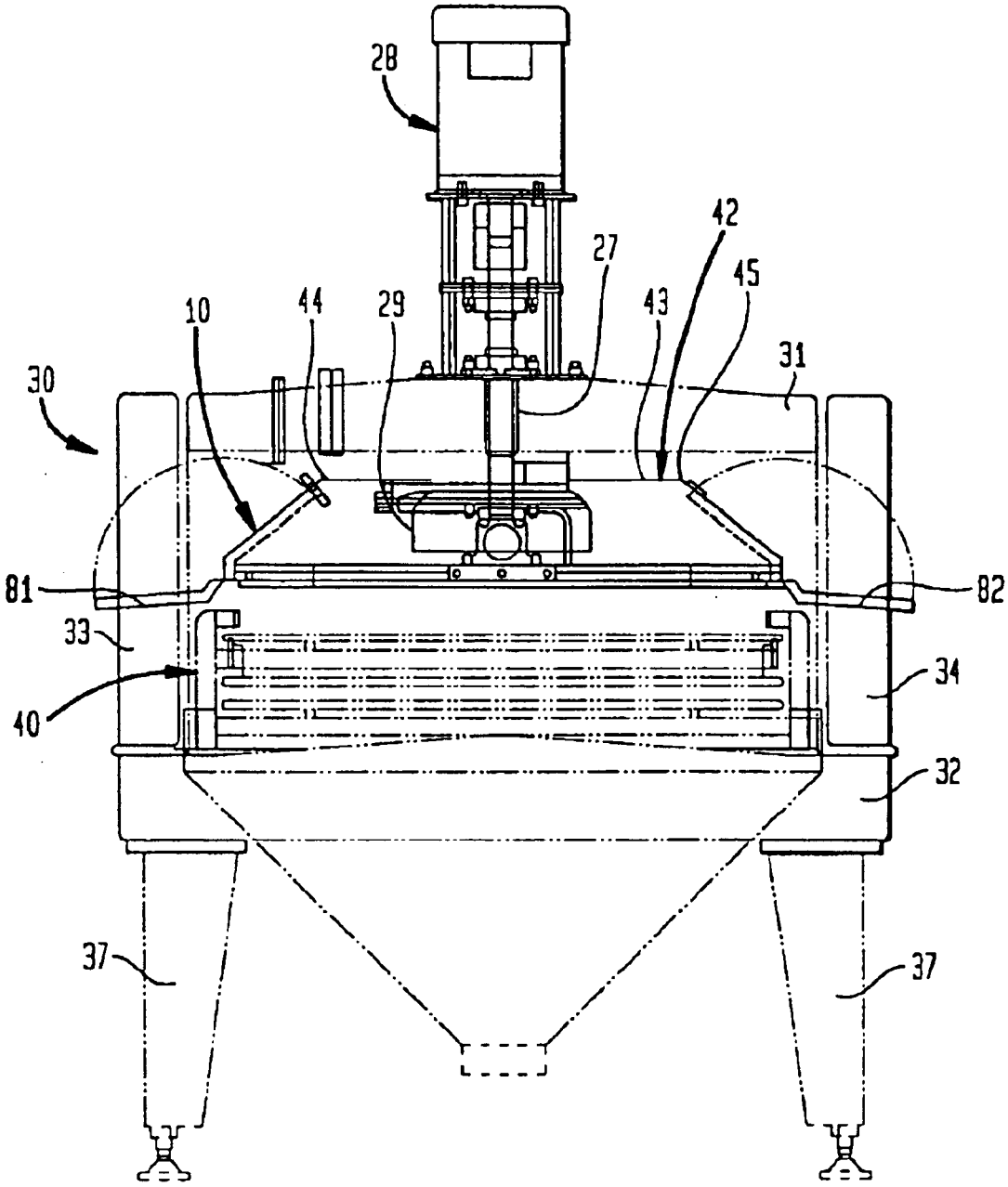
FIG. 2 is a cross-sectional view of the tunnel freezer of the second embodiment.
Figure 3:
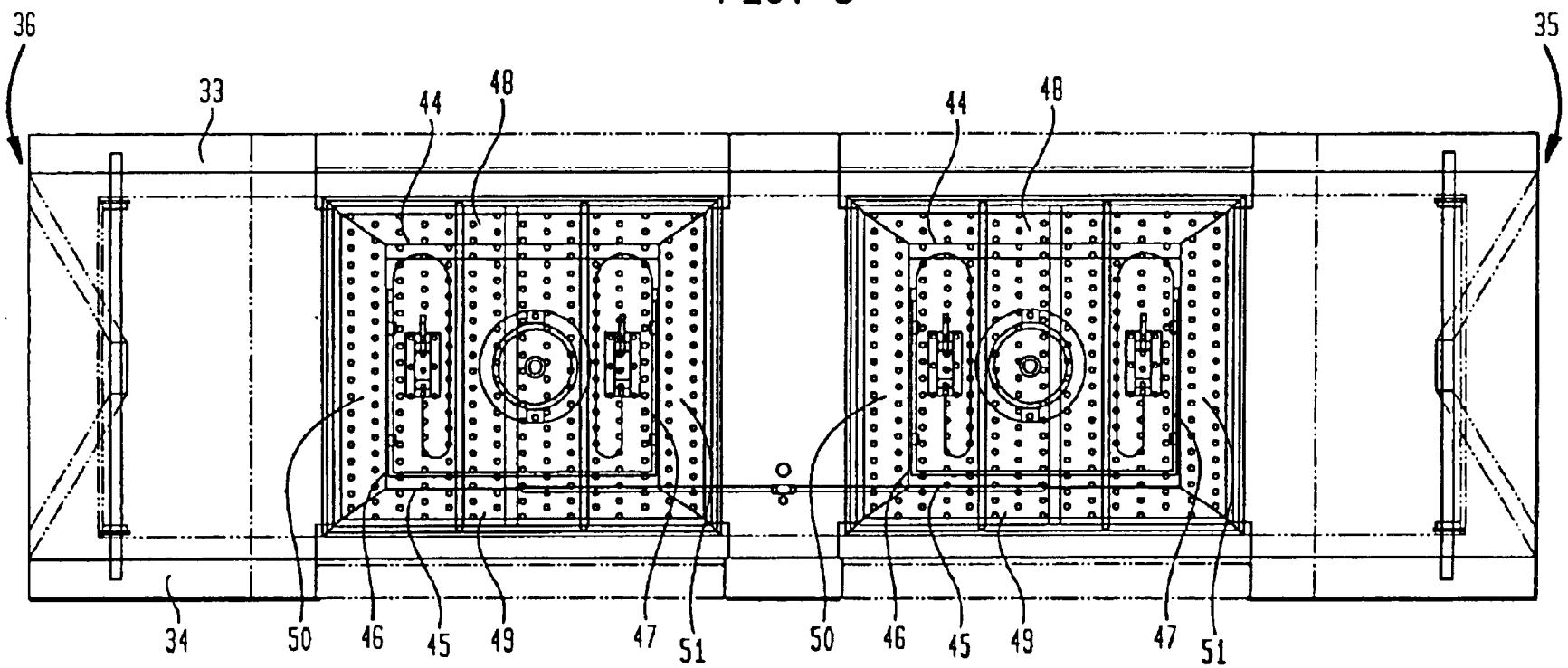
FIG. 3 is a cross-sectional view of the tunnel freezer of the second embodiment showing the location of configuration of the impingement hoods.
Figure 4:
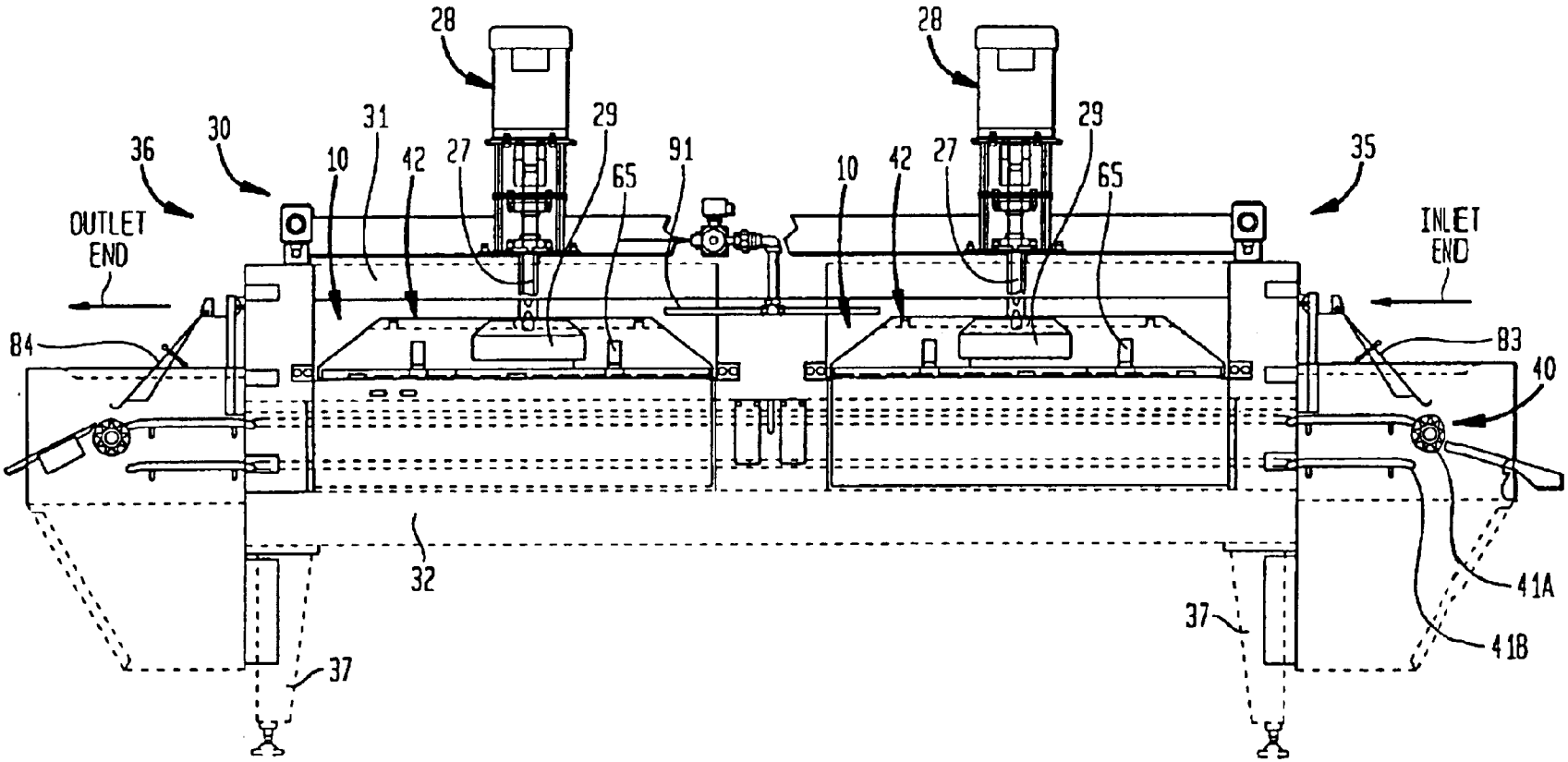
FIG. 4 is a side plan view of the tunnel freezer of the second embodiment.

As seen in FIG. 1, the impingement hood 10 is provided inside the tunnel freezer 20, and as seen in FIGS. 2-4, the impingement hood 10 is provided inside the tunnel freezer 30. The tunnel freezer 20 includes an insulated ceiling portion 21, an insulated floor portion 22, insulated side walls 23 and 24, and entrance and exit doors (not shown). Inside the tunnel freezer 20, the impingement hood 10 may be attached to the ceiling 21 using attachment brackets 25 and 26. Extending through the ceiling 21 is a motor shaft 27 attached to a motor 28. The motor 28 is located on the exterior of the tunnel freezer 20, and is provided with an electrical supply (not shown). The motor 28 drives an impeller 29 to circulate gas inside the impingement hood 10.

Like the tunnel freezer 20, the tunnel freezer 30 includes an insulated ceiling portion 31, an insulated floor portion 32, insulated side walls 33 and 34, an entrance 35 and an exit 36. The tunnel freezer 30 may be supported by legs 37 provided at each of the four corners of the floor portion 32. Furthermore, the tunnel freezer 30 includes at least two impingement hoods 10. One impingement hood 10 is located adjacent the entrance 35 and the other impingement hood 10 is located adjacent the exit 36. The use of two impingement hoods 10 increases the heat transfer capability of the freezer 30. The impingement hoods 10 may be attached to the ceiling 10 using attachment brackets (not shown).

Like the tunnel freezer 20, the tunnel freezer 30 has motor shafts 27 extending through the ceiling 21. The motor shafts 27 are aligned with either of the impingement hoods 10, and are attached to motors 28 that drive impellers 29. The motors 28 are located on the exterior of the tunnel freezer 30, and are attached to electrical supplies (not shown). The motors 28 drive impellers 29 to circulate gas inside the impingement hoods 10 to ultimately generate impingement jets 11.

Respectively provided underneath the impingement hoods 10 in both of the tunnel freezers 20 and 30 are conveyer systems 38 and 40. The conveyer systems 38 and 40 respectively have first and second conveyer belts 39A and 39B, and first and second conveyer belts 41A and 41B. As seen best in FIGS. 1 and 4, first conveyer belt 39A is provided over second conveyer belt 39B, and second conveyer belt 41A is provided over second conveyer belt 41B. As such, there are two paths for moving food product 12 through the tunnel freezers 20 and 30. For example, in tunnel freezer 30, the first conveyer belt 41A and second conveyer belt 41B move the food product 12 placed thereon from the entrance 35 to the exit 36. Furthermore, the conveyer belts 39A and 39B, and 41A and 41B are preferably constructed of woven stainless steel material. Therefore, the impingement jets 11 can respectively pass through the first conveyer belts 39A, 41A to the second conveyer belts 39B, 41B. Therefore, food product 12 on the second conveyer belts 39B, 41B can be cooled separately from the food products 12 on the first conveyer belts 39A, 41A. As such, the food product 12 on the first conveyer belts 39A, 41A could be frozen, and the food product 12 on the second conveyer belts 39B, 411B could be chilled.

Each of the impingement hoods 10 include a frusto-pyramidal shaped shell 42. The shell 42 is composed of a rectangular-shaped top plate 43 having first opposed edges 44, 45, and second opposed edges 46, 47. The shell 42 also includes first opposed side walls 48, 49 and second opposed side walls 50, 51. The first opposed side walls 48, 49 and second opposed side walls 50, 51 extend downwardly at an angle from the respective edges of the top plate 43. As such, the first opposed side walls 48, 49 and second side walls 50, 51 form the inclined portion of the frusto-pyramidal shape of the shell 42. In certain embodiments, extending downwardly from the lower edges of the first opposed side walls 48, 49 and second opposed side walls 50, 51 are first opposed L-shaped members 52, 53, and second opposed L-shaped members (not shown). Each of the L-shaped members have leg portions 54 and foot portions 55. The foot portions 55 serve as ledges to support the impinger 13.

Figure 5:
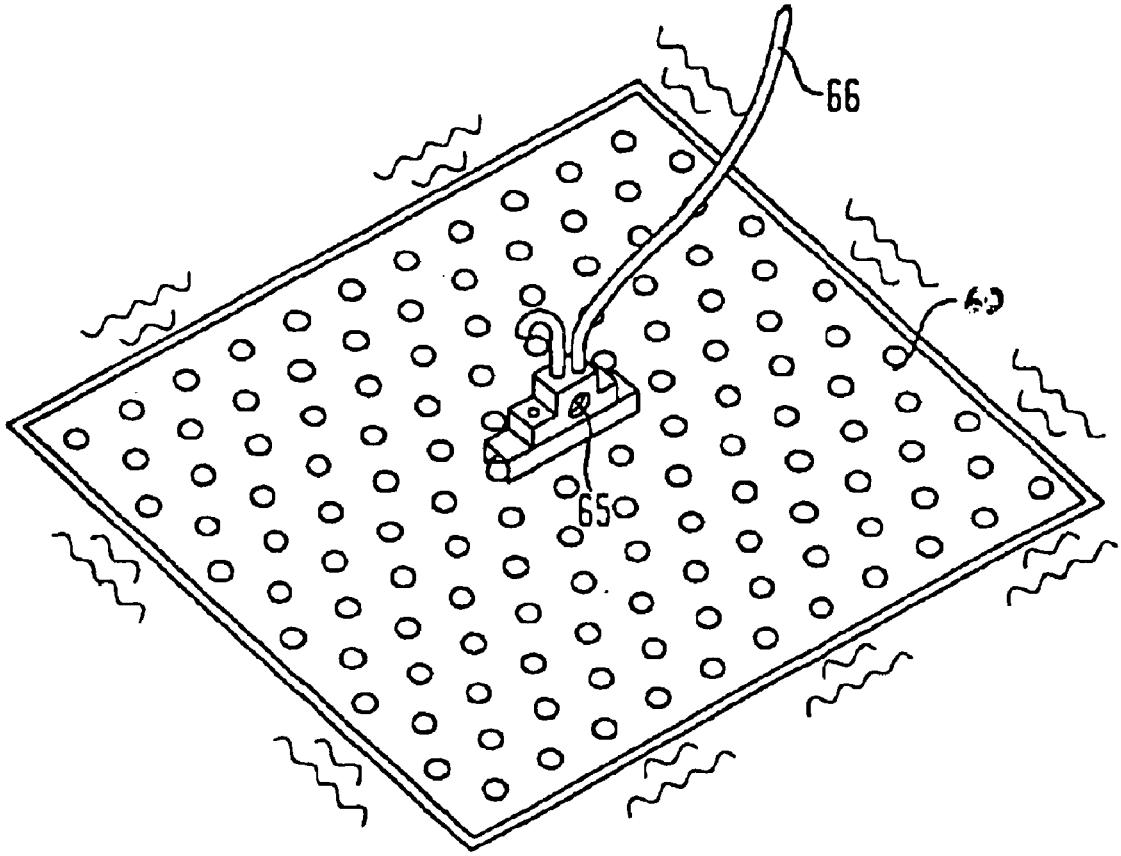
FIG. 5 is perspective view of an impingement plate forming the impinger.
Figure 7:
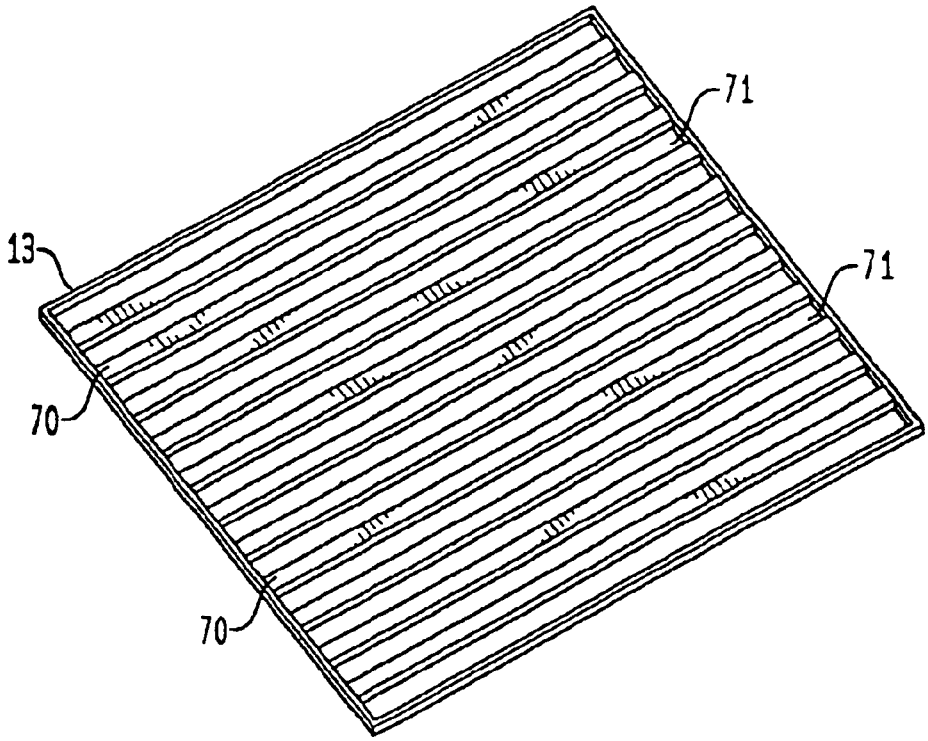
FIG. 7 is a perspective view of a series of metal rails forming the impinger.

The impinger 13 can take the form of an impingement plate 60 or series of metal rails collectively referred to with the numeral 70. The impingement plate 60 is best seen in FIG. 5, and the series of metal rails are best seen in FIG. 7. The impingement plate 60 includes a hole pattern, and may be fabricated from 22-gauge sheet metal in one embodiment. In certain embodiments, the area of the holes may be between about 3% and about 6% of the total area of the impinger 13. In one embodiment, the area of the holes is about 4% to about 5% of the total area of the impinger 13.

Figure 6:
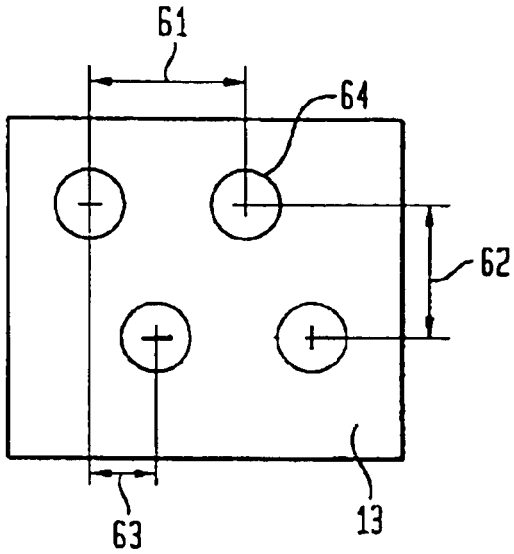
FIG. 6 is a top plan view of a portion of the impingement plate.

By way of example but not limitation, for certain embodiments, the hole pattern is shown in FIG. 6, and the axial pitch 61 and lateral pitch 62 are both about 1⅞ inches, and the hole diameter 64 is ½ inch. The offset or stagger 63 of the center of the holes may be approximately ⅝ inch in this embodiment. Furthermore, the holes may be chamfered to prevent ice from building-up within the hole, and to produce impingement jets 11 having a velocity profile effective in chilling or freezing the food product 12. Also, the offset or stagger 63 is provided to produce impingement jets 11 providing an even or consistent chilling or freezing of food product 12 across the width of the conveyer belts. These impingement jets 11 advantageously reduce or eliminate impingement lines on the food products.

The impingement plate 60 may also be provided with a vibrator 65 as seen in FIG. 5. The vibrator 65 may be of the electrical variety, however, in one embodiment vibrator 65 is a ball valve pneumatically actuated by compressed nitrogen or carbon dioxide gas supplied through conduits 66 at about 80 psi. The vibrations provided by the vibrator 65 prevent snow and ice from building-up on the impingement plate 60. Furthermore, the frequency and time intervals of the vibrations provided by the vibrator 65 may vary depending on the process conditions including the moisture content of the food product, the humidity of the ambient air in and outside the tunnel freezers 20 and 30, and the temperature of the tunnel freezer.

Figure 8:
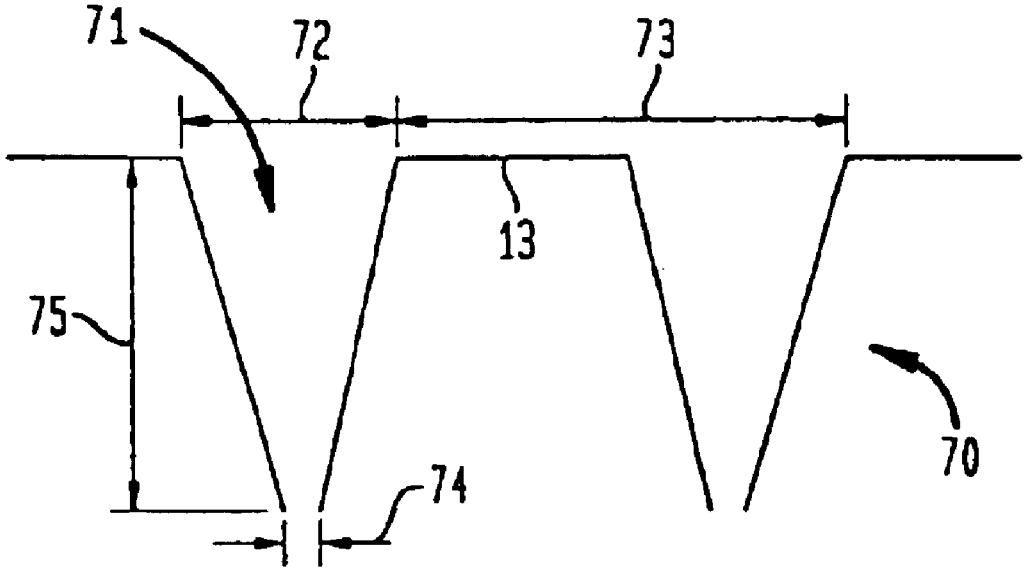
FIG. 8 is a cross-sectional view of a portion of the series of metal rails.

The series of metal rails 70 forming the impinger 13 includes channels 71 formed between the individual rails. The channels 71 are best seen in FIG. 8. By way of example, in one embodiment, the channel width 72 may be approximately 3 inches, the channel pitch 73 may be approximately 12 inches, channel depth 75 may be approximately 14 inches, and the channel opening 74 may be approximately ⅝ inch.

With either form of the impinger 13, the distance from the bottom of the impinger 13 to the surface of the food product 12 may vary from approximately 1 inch to approximately 5 inches, and in one embodiment may be approximately 3 inches. The distance from the bottom of the impinger 13 to the food product 12, and the arrangement of the hole pattern on the impingement plate 60 or the series of metal rails 70 is designed to increase the total heat transfer rate.

In addition, the first side walls 48, 49 of the impingement hood 10 may be provided with pivotable doors 81, 82 that swing outwardly from the shell 42. The pivotable doors 81, 82 conform to the shape of the shell 42, and allow for access to the interior of the impingement hood 10. Such access allows the impinger 13 to be cleaned. Furthermore, to prevent outside heat from entering through entrance 35 and exit 36, the tunnel freezer 30 may be provided with first and second infiltration hoods 83 and 84. The first infiltration hood 83 is located near the entrance 35 and the second infiltration hood 84 is located near the exit 36.

As discussed hereinabove, in both of the tunnel freezers 20 and 30, the gas circulated by the impellers 29 inside the impingement hoods 10 is mixed with a supply of solid or liquid cryogen to create mixture 14 supplied either inside or outside the impingement hoods 10. The mixture 14 is directed to the impinger 13 where the impingement jets 11 are ultimately generated. The velocity of the impingement jets 11 is controlled by the hole diameter 64, or channel width 72 and channel opening 74. Increasing the velocity of the impingement jets 11 also increases the total heat transfer rate. However, at a certain point, the velocity of the impingement jets 11 may be sufficient to damage the food product 12, or to carry the food product 12 off the conveyer belts, and into undesirable locations elsewhere in the tunnel freezers 20 and 30. Therefore, the velocity of the impingement jets 11 is controlled to maximize the total heat transfer rate and to minimize the possibility of damaging the food product 12. During this process, the impingement jets 11 are capable of breaking through the thermal boundary layer of the food product 12 to immediately freeze the food product 12, and reduce the possibility of dehydration of the food product 12.

As described hereinabove, the impingement jets 11 are directed to the food products located on the conveyer belts. Because the impingement jets 11 are directed downwardly, the danger of food product 12 being entrained in the reflected gas stream 90 is decreased. Consequently, the reflected gas stream 90 can be re-circulated to the impingement hood 10. For example, the impellers 29 are used to direct mixture 14 toward the impinger 13, but may also be used to draw the reflected gas stream 90 into the interior of impingement hood 10. As such, there is an efficient path for re-circulation of the reflected gas stream 90 provided in the tunnel freezers 20 and 30. The re-circulation of the reflected gas stream 90 advantageously increases the efficiency of the tunnel freezers 20 and 30. Furthermore, the tunnel freezer 30 can be equipped with a sprayer 91 to further release solid or liquid cryogen into the tunnel freezer 30. Therefore, droplets of solid or liquid cryogen can be captured in a reflected gas stream 90 as it is re-circulated to the interior of the impingement hood 10.

An apparatus is therefore provided for cooling or freezing food products comprising: a housing having a chamber defined therein by side walls between a ceiling and floor of the housing; at least one conveyor extending into the chamber between the ceiling and floor; and a liquid or solid cryogen supply; characterised by having at least one impingement hood in the chamber disposed above the conveyor; the impingement hood comprising: a shell having a top, opposed edges and opposed side walls supporting an impinger, a coolant delivery device enclosed by the shell including a gas circulation device for directing a mixture of gas and solid or liquid cryogen to the impinger, the impinger comprising an impingement plate containing openings for directing impingement jets of the mixture onto the products transported on the conveyor. The housing components may be insulated.

A process is also provided for cooling or freezing food products within a housing chamber defined by insulated side walls between an insulated ceiling and floor, at least one conveyor extending into the chamber disposed between the ceiling and floor, and including a cryogen supply, comprising transporting the food products on the conveyor, characterised by the chamber containing at least one impingement hood disposed above the conveyor; the impingement hood comprising a shell including a top, opposed edges and opposed side walls supporting an impinger comprising an impingement plate containing openings, the process further comprising mixing gas and solid or liquid cryogen within the impingement hood, directing the mixture of gas and cryogen to the impinger, directing impingement jets of the mixture through the impingement plate onto the food products transported on the conveyor.

An impingement hood is further provided, suitable as a retrofit for a freezing or cooling apparatus, comprising: a shell having a top, opposed edges and opposed side walls supporting an impinger; the shell being adapted to accommodate a coolant delivery device including a gas circulation device for directing a mixture of gas and solid or liquid cryogen to the impinger, the impinger comprising an impingement plate containing openings for providing impingement jets of the mixture external to the shell.

Food freezing apparatus and methods are disclosed in U.S. Pat. Nos. 4,803,851; 6,263,680; and 6,434,950; and in U.S. Published Patent Application No. 2001/0025495, all assigned to The BOC Group. These patents and application are incorporated by reference herein, as if fully written below.

Although the invention has been described in detail through the above detailed description and the preceding examples, these examples are for the purpose of illustration only and it is understood that variations and modifications can be made by one skilled in the art without departing from the spirit and the scope of the invention. It should be understood that the embodiments described above are not only in the alternative, but can be combined.

We claim:

1. An apparatus for cooling or freezing food products comprising:

a tunnel housing having a chamber defined therein by side walls between a ceiling and floor of the housing;

at least one conveyor extending into the chamber between the ceiling and floor;

a solid or liquid cryogen supply; and, at least one impingement hood in the chamber disposed above the conveyor;

the impingement hood comprising:

a shell having a top, opposed edges and opposed side walls supporting an impinger, a coolant delivery device in communication with the cryogen supply, the coolant delivery device enclosed by the shell including a gas circulation device for directing a mixture of gas and sold or liquid cryogen to the impinger, the impinger comprising an impingement plate containing openings for directing impingement jets of the mixture onto the products transported on the conveyor.

2. The apparatus of claim 1 wherein the impingement plate contains a pattern of holes through which the impingement jets are directed, the area of the holes being between about 3% and about 6% of the total area of the impingement plate.

3. The apparatus of claim 1 wherein the openings are chamfered holes.

4. The apparatus of claim 1 wherein the impingement plate contains open channels between rails through which the impingement jets are directed.

5. The apparatus of claim 1 wherein the cryogen supply comprises a cryogen supply port opening within the impingement hood.

6. The apparatus of claim 1 wherein the cryogen supply comprises a cryogen supply port opening within housing chamber external to the impingement hood.

7. The apparatus of claim 1 including at least an upper and a lower food products conveyor, wherein the upper conveyor has openings to permit the impingement jets to penetrate to the food products on the surface of the lower conveyor.

8. The apparatus of claim 1 wherein the gas circulation device comprises an impeller.

9. The apparatus of claim 1 wherein the gas circulation device comprises an axial flow fan.

10. The apparatus of claim 1 wherein the impingement plate is provided with a vibrator.

11. The apparatus of claim 1 comprising a plurality of modules within the housing chamber, each module including at least one impingement hood disposed above the conveyor.

12. A process for cooling or freezing food products within a tunnel housing chamber comprising:

transporting the food products on a moving substrate within the chamber;

mixing a gas with solid or liquid cryogen within an at least partially enclosed impingement hood above the substrate; the impingement hood comprising a shell supporting an impinger, the shell being adapted to accommodate a gas circulation device for directing a mixture of gas and solid or liquid cryogen to the impinger, the impinger comprising an impingement plate containing openings for providing pressurized impingement jets of the mixture external to the shell; and selectively directing the pressurized impingement jets of the mixture from the impingement hood onto the food products transported on the substrate.

13. The process of claim 12 including introducing the solid or liquid cryogen within the impingement hood.

14. The process of claim 12 including introducing the solid or liquid cryogen within the housing chamber external to the impingement hood, and circulating gas and the cryogen into the impingement hood for further mixing with the gas.

15. The process of claim 12 wherein the housing chamber includes at least an upper and a lower food products transport substrate, wherein the upper substrate has openings to permit the impingement jets to penetrate to the food products on the surface of the lower substrate, the process further including directing the impingement jets to contact the food products on the upper substrate and on the lower substrate.

16. The process of claim 12 including re-circulating the mixture of gas and the cryogen after impingement onto the food products from the housing chamber into the impingement hood.

17. An impingement hood for a freezing or cooling apparatus comprising:

a shell having a top, opposed edges and opposed side walls supporting an impinger;

the shell being adapted to accommodate a coolant delivery device including a gas circulation device for directing a mixture of gas and solid or liquid cryogen to the impinger, the impinger comprising an impingement plate containing openings for providing impingement jets of the mixture external to the shell.

18. The impingement hood of claim 17 wherein the impingement plate contains a pattern of holes through which the impingement jets are directed.

19. The impingement hood of claim 17 wherein the impingement plate contains open channels between rails through which the impingement jets are directed.

20. The impingement hood of claim 17 wherein the side walls have pivotable access doors.

21. The impingement hood of claim 17 wherein the impingement hood is adapted to be retro-fit into a tunnel freezer or cooler having an axial flow fan.

* * * * *

UNITED STATES PATENT AND TRADEMARK OFFICE

CERTIFICATE OF CORRECTION

PATENT NO. : 6,877,327 B2
DATED : April 12, 2005
INVENTOR(S) : Michael D. Newman et al.

It is certified that error appears in the above-identified patent and that said Letters Patent is hereby corrected as shown below:

Column 8,
Line 57, replace "sold" with -- solid --.

Signed and Sealed this

Twenty-fourth Day of January, 2006

JON W. DUDAS
*Director of the United States Patent and Trademark Office*